United States Patent [19]

Battles

[11] Patent Number: 4,805,853

[45] Date of Patent: Feb. 21, 1989

[54] AUTOMATIC ACTION TOY GLIDER-KITE STRING FLYER

[76] Inventor: Willis R. Battles, 560 S. Helberta, Redondo Beach, Calif. 90277

[21] Appl. No.: 73,167

[22] Filed: Jul. 13, 1987

[51] Int. Cl.[4] ..... B64C 31/06

[52] U.S. Cl. ..... 244/155 R; 244/153 R

[58] Field of Search ..... 244/155 R, 153 R, 153 A

[56] References Cited

U.S. PATENT DOCUMENTS

| | | | |
|---|---|---|---|
| 2,785,871 | 3/1957 | Flint | 244/155 R |
| 3,208,697 | 9/1965 | Bayha | 244/155 R |
| 3,227,404 | 1/1966 | Scharge | 244/155 R |
| 3,596,857 | 8/1971 | Battles | 244/155 R |
| 3,752,424 | 8/1973 | Battles | 244/155 R |
| 3,968,948 | 7/1976 | Schmidt | 244/155 R |
| 4,129,274 | 12/1978 | Baker | 244/155 R |
| 4,465,251 | 8/1984 | Newbold | 244/155 R |

*Primary Examiner*—Galen Barefoot

[57] ABSTRACT

Improvements to the design of the Kite-String Flyer described in my previous U.S. Pat. No. 3,752,424 include:

attachments providing means for setting the elevator angles on the wing for better flight control;

an improved launching mechanism for parachutes, etc., aloft;

the use of ribbons attached to the rear surface of the wing to provide additional air resistance as they flutter in the breeze during flyer's dive down the kite string, thus slowing the descent rate and adding visual appeal to the flight of the flyer;

the use of a ¾ inch cube of a resilient foam cushion material attached to the front of the fuselage to protect against sting or injury to hands or body in case of contact at bottom of flight of flyer down the kite string;

an improved mounting method of elastic holding hook to wing and of wing to fuselage to facilitate quick assembly of the flyer from a kit where the parts are packaged flat to provide a more convenient shipping package.

3 Claims, 2 Drawing Sheets

AUTOMATIC ACTION TOY GLIDER-KITE STRING FLYER

FIELD OF INVENTION

This invention relates to improvements in the automatic action toy glider-kite string flyer of my previous invention as described in U.S. Pat. No. 3,752,424.

DESCRIPTION OF PRIOR ART

A number of kite string flyers have been described in the previous literature. Typical issued patents are U.S. Pat. No. 1,172,198 issued to Cornell, U.S. Pat. No. 2,041,233 issued to Cutshall, and U.S. Pat. No. 2,833,497 issued to Yound. All of these devices require manual reset before the flyer could climb the kite string again, prior to the dive down action. Another prior patent, by the present inventor (U.S. Pat. No. 3,596,857), provided automatic reset of the wing. This was succeeded by a later U.S. Patent by the present inventor (U.S. Pat. No. 3,752,424), that was a simpler design and more practical. However, this last embodiment left room for improvements in flight control and safety of the operator.

SUMMARY OF THE INVENTION

The design covered by my patent, U.S. Pat. No. 3,752,424 needed several improvements to function better. There was a need to provide a simple changeable means of adjusting the elevator tabs at the rear wind tips in order to provide better flight control, as will be later described. Another desired improvement was to prevent injury or stinging of the hand by the flyer at the bottom of its rapid dive, if the hand or other body part should be on the string in the dive path of the flyer. This improvement was provided in two ways: first, by fastening a small cube of resilient foam material to the front of the fuselage; second, by attaching ribbons to the rear edges of the wing to provide extra air resistance as they flutter in the wind during the flyer's dive, and thus slow the dive to a safer rate. The action of these ribbons, of various colors, also adds much eye appeal to the dive as they flutter in the breeze.

Another improvement to my flyer is a new design of parachute launching mechanism, which also improves the safety of the flyer's dive.

DESCRIPTION OF THE PREFERRED EMBODIMENT

Figure 1:
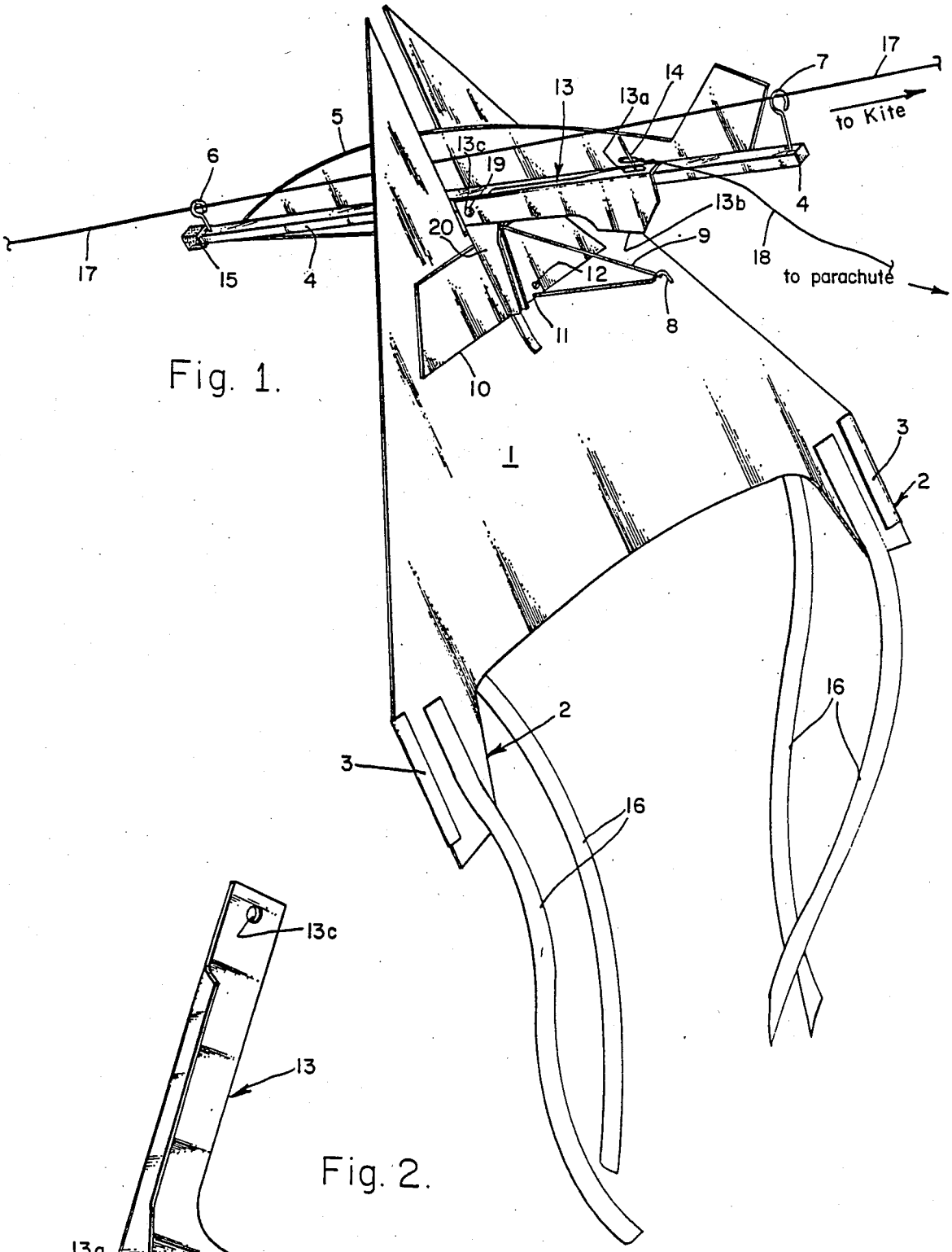
FIG. 1 is a three-quarter side pictorial view of the kite-string flyer, with the wing folded down in the string-climbing position and with the lauching device in the down position, ready to hook on a tether to a parachute, etc., preparing it for launch at the top of flyer's climb.
Figure 2:
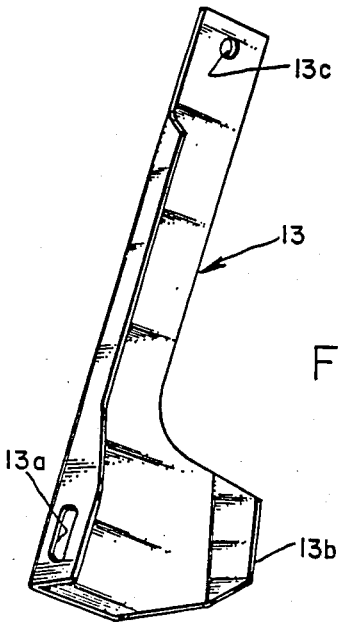
FIG. 2 is a perspective pictorial view of the launch device.
Figure 3:
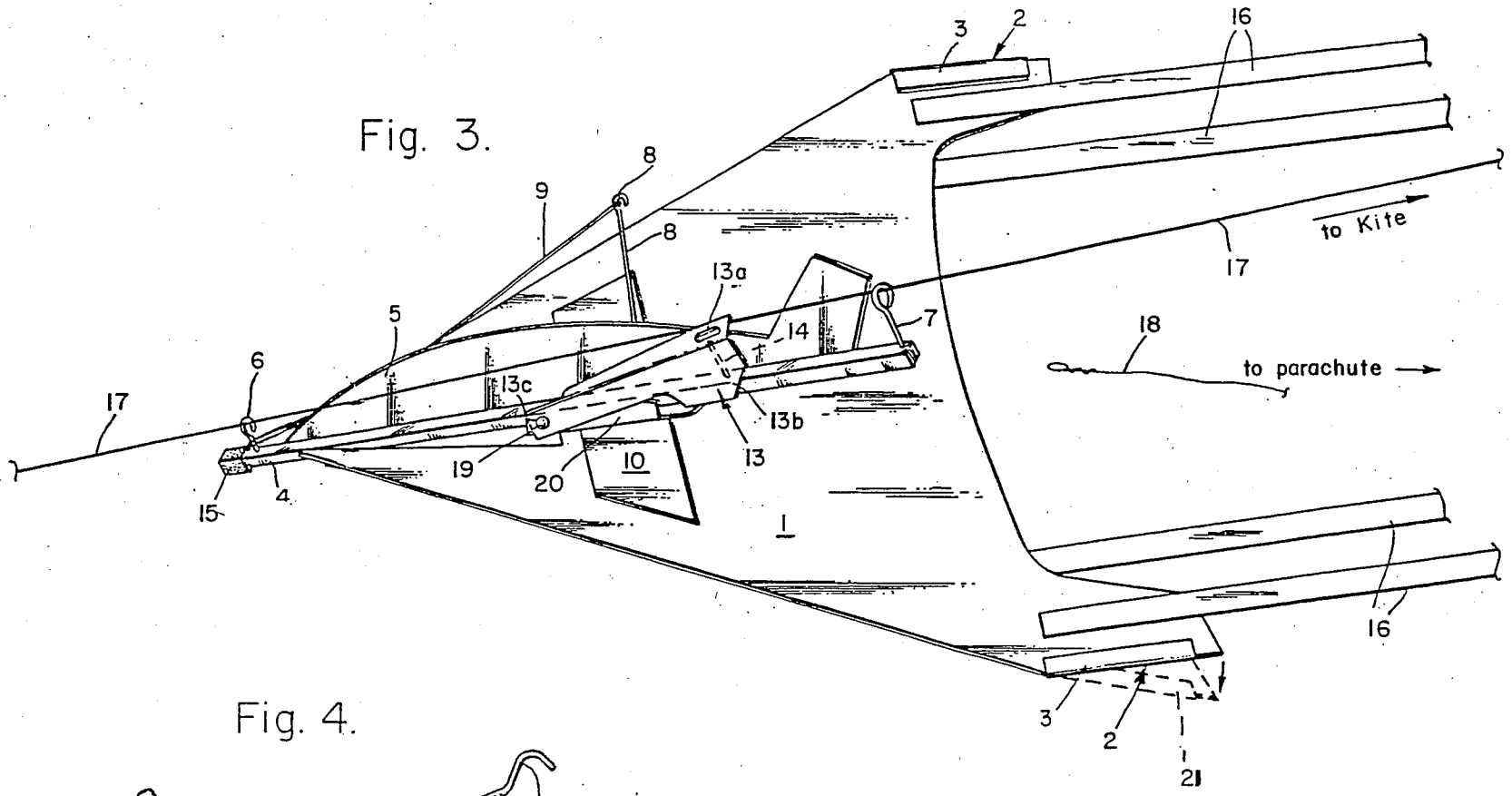
FIG. 3 is a three-quarter side-top pictorial view of the kite-string flyer embodying the principles of this invention showing the wing folded up into diving position 5 and with the launch device in the up (launch) position.

Referring to FIGS. 1 and 3, the fuselage of the kite-string flyer consists of a fuselage stick 4 of solid wood or plastic square or dowel piece, and a thin plastic silhouette piece 5 fastened to the rod 4 to give the appearance of an airplane fuselage as viewed from the side. Mounted to the fuselage structure is a pivotal wing 1 which is a single sheet of plastic or other light weight material. The flyer is suspended from the kite line 17 by a first split ring eye hook 6 and a second split ring eye hook 7, on which it can slide up and down the kite line 17. The wing 1 contains a 1 inch wide front slotted section reaching to about one half the wing depth. Attached to the wing 1 is an elastic holding hook 8 which reaches several inches above the wing 1 surface and is fastened adjacent to the fuselage at a notch 11 in base piece 10 a point approximately one and a half inches to the rear of the slotted section. An elastic band 9 connects the hook 8 to the front of the fuselage stick 4 in a manner such that the wing 1 can execute a toggle action of approximately 90 degrees from the horizontal to a vertical position, with the elastic band 9 riding in the wing slot.

The fuselage structure, wing and all components must meet certain requirements. These are:

1. Be light enough in weight to allow the flyer to climb the kite line by the wind's force when the wing is vertical; and
2. Be heavy enough to dive back down the kite line under the influence of gravity, when the wing is in a horizontal position.

Several improvements over the former embodiment were desired. These are:

(1) Removal of the pulley wheel (shown in the original U.S. Pat. No. 3,752,424, but removed in this embodiment) which is not needed, since eye hooks 6 and 7 allow ample sliding motion on the kite line 17.

(2) An ability to set the wing elevators at different angles, to provide better aerodynamic control of the flyer.

(3) A better and safer launching mechanism for objects high in the sky.

(4) A method of reducing the diving speed of the flyer as is descends the kite line.

(5) A method of protecting the hands and body of the operator when striking the front of the flyer at the end of its rapid dive.

(6) An efficient mounting method of the wing elastic hook which also facilitates assembly of the kit.

(7) All parts designed so that the flyer could be assembled in less than 5 minutes.

The following description will explain how these improvements are accomplished in the present embodiment.

As a safety improvement, affixed to the front of the solid support fuselage member 4 is a resilient cubic member 15 of foam rubber or other resilient material. The purpose of this resilient member is to cushion the blow which the front of the fuselage might make against a hand or other body part which might be in the way at the bottom of the flyer's dive.

Another improvement over the prior design is the addition of launch part 13 and wire tether hook 14, to the fuselage. Wire tether hook 14 projects upward from the fuselage and provides a location on which to hook a loop or button from a tether 18 that is approximately two feet long. The trailing end of this tether is fastened to a parachute, a flyer, or other object to be launched high in the air. Launch part 13 is fastened to the fuselage member 4 through hole **13*c* by the same bolt 19 which also holds the wing hinge piece 20 to the fuselage. Hinge piece 20 is securely riveted to the wing through wing brace piece 10. Launch part 13 has a slot 13***a* in its top surface which fits over the wire hook 14 when wing is in the climb position of FIG. 1. Launch part 13 also has an under-projecting tab portion 13*b*, which catches below the fuselage, limiting its upward travel as shown in FIG. 3. FIG. 3 also shows that the slot 13*a* of launch part 13 is above the top of wire tether hook 14, when the wing 1 folds up into diving position. It causes the following action: In the diving attitude shown in FIG. 3, the top surface of the wing 1 contacts tab 13*b* of part 13 and pushes launch part 13 up to the position shown in FIG. 3. In so doing, the button or loop of the tether 18 is pushed up and off wire tether hook 14, launching the tether and its parachute, etc., high in the air. The tab 13*b* is shown limiting the upward travel of part 13 in FIG. 3, as it catches beneath the fuselage at the limit of its upward travel. Launch part 13 also provides a safety feature during the flyer's dive, since its smooth top surface is then above the end of wire hook 14, thus protecting the operator's hands or body from a possible scratch from the top end of wire hook 14.

An improvement to the Kite-String Flyer flight control is obtained by the attachment of an elevator control piece 3 to each of the elevator trim tabs 2 at the aft of the wing 3. Each elevator control piece 3 is made of a light flexible material, such as aluminum, which when bent, tends to hold its shape. This is shown in FIG. 3 where the dashed line indicates the position of left trim tab 2 bent to position 21. In this position, during flyer's climbing flight, this elevator tab acts in a cup fashion to catch more air and facilitate the upward folding of the wing. If one tab is bent upward and the other one bent down, the resulting air pressure on these tabs can cause a rotation of the flyer in its downward flight, performing exciting barrel rolls as it dives down the kite line.

Ribbons 16 are attached to the aft surface of the wing 1 to provide additional air resistance as they flutter in the breeze during the kite-flyer's dive down the kite string 17, thus slowing the descent and adding visual appeal to the flight of the flyer.

Figure 4:
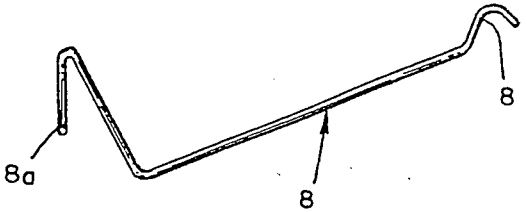
FIG. 4 illustrates the shape of the elastic hook to which is fastened an elastic band.

A further improvement is found in the method used for mounting elastic hook 8 on the wing. Elastic hook 8 is shown in FIG. 4. The short portion 8a of elastic hook 8 is slipped between wing brace 10 and the surface of the wing 1, fitting against a notch 11 in the wing brace 10. This notch 11, is so located as to set the tranverse position of elastic hook 8 such that the elastic band attached to hook 8 and to the base of hook 6, rides freely in the front slot of the wing 1 as the wing 1 pivots back and forth. A bolt 12 is used to tighten the wing brace 10 to the wing 1. It also holds elastic hook 8 in place.

The wing brace 10 is fastened to the wing 1 in several places. These are (a) by cement at its extremities, (b) by bolt 12 described earlier, and (c) by rivets which hold wing hinge 20 to the wing 1.

These changes in the method of attachment of a number of parts, permit a flat package to be made of subassembled parts, and a quicker final assembly of the flyer. All of the parts can be laid flat and then packaged in an envelope only ½ inch thick, thus permitting easy storage and shipping. By the use of bolts, final assembly of the flyer can be made from the kit in less than 5 minutes.

The improvements to the flyer thus provide a safer toy with improved aerodynamic functioning. They also include an improved launching mechanism and design changes to permit better packaging and simpler, quicker assembly.

I claim:

1. In an improved Kite-String Flyer operable to travel up and down an inclined string such as a kite string, comprising in combination:

(a) a fuselage;

(b) a pivotal wing for operating aerodynamically and incorporating a slot in its center section;

(c) a guide and support means including two split ring eye hooks disposed in spaced apart positions over and fastened to said fuselage and operable to freely receive the kite string, allowing the flyer to slide up and down;

(d) pivot means secured to said wing at a position displaced from the center of gravity thereof and secured to said fuselage for pivotally mounting said wing to said fuselage for rotation on a transverse axis between a generally horizontal plane and a generally vertical plane; and (e) toggle action means of assisting said wing to execute a toggle action of approximately 90 degrees from the horizontal to a vertical position; said toggle means including an elastic band affixed to the front end of said fuselage and also affixed to an elastic holding hook; said elastic holding hook being fastened to said wing surface at a point adjacent to said fuselage and to the rear of said wing slot, said elastic holding hook projecting several inches above said wing surface in order to provide a leverage position for said elastic band; wherein the improvement comprises: a means for protecting the kit operator from receiving a blow made by the front of the fuselage when the flyer dives; an improved launching means; a means for reducing the diving speed of the flyer; wherein said means of protecting the operator comprises a cubic member of foam rubber or other resilient compressible material attached to the front of the fuselage.

2. In an improved Kite-String Flyer operable to travel up and down an inclined string such as a kite string, comprising in combination:

(a) a fuselage;

(b) a pivotal wing for operating aerodynamically and incorporating a slot in its center section;

(c) a guide and support means including two split ring eye hooks disposed in spaced apart positions over and fastened to said fuselage and operable to freely receive the kite string, allowing the flyer to slide up and down;

(d) pivot means secured to said wing at a position displaced from the center of gravity thereof and secured to said fuselage for pivotally mounting said wing to said fuselage for rotation on a tranverse axis between a generally horizontal plane and a generally vertical plane; and (e) toggle action means of assisting said wing to execute a toggle action of approximately 90 degrees from the horizontal to a vertical position; said toggle means including an elastic band affixed to the front end of said fuselage and also affixed to an elastic holding hook; said elastic holding hook being fastened to said wing surface at a point adjacent to said fuselage and to the rear of said wing slot, said elastic holding hook projecting sevveral inches above said wing surface in order to provide a leverage position for said elastic band; wherein the improvement comprises: a means for protecting the kit operator from receiving a blow made by the front of the fuselage when the flyer dives; an improved launching means; a means for reducing the diving speed of the flyer; wherein said means of reducing the diving speed of the flyer includes attached to said wing rear surface multiple varicolored ribbons; said ribbons providing additional air resistance to the flyer as it dives down the kite string, thus slowing the descent; said ribbons also providing increased eye appeal of the flyer as they flutter.

3. In an improved Kite-String Flyer operable to travel up and down an inclined string such as a kite string, comprising in combination:

(a) a fuselage;

(b) a pivotal wing for operating aerodynamically and incorporating a slot in its center section;

(c) a guide and support means including two split ring eye hooks disposed in spaced apart positons over and fastened to said fuselage and operable to freely receive the kite string, allowing the flyer to slide up and down;

(d) pivot means secured to said wing at a position displaced from the center of gravity thereof and secured to said fuselage for pivotally mounting said wing to said fuselage for rotation on a tranverse axis between a generally horizontal plane and a generally vertical plane; and (e) toggle action means of assisting said wing to execute a toggle action of approximately 90 degrees from the horizontal to a vertical position; said toggle means including an elastic band affixed to the front end of said fuselage and also affixed to an elastic holding hook; said elastic holding hook being fastened to said wing surface at a point adjacent to said fuselage and to the rear of said wing slot, said elastic holding hook projecting several inches above said wing surface in order to provide a leverage position for said elastic band; wherein the improvement comprises: a means for protecting the kite operator from receiving a blow made by the front of the fuselage when the flyer dives; an improved launching means; a means for reducing the diving speed of the flyer; wherein said improved launching means includes a launching system being comprised of two parts:

a. a wire hook comprised of thin wire attached to said fuselage and projecting vertically upward, and to which one end of a tether may be hooked, the other end of the tether being attached to a parachute or other device to be launched; and b. a launching part designed to push said tether up off said wire hook as the wing folds up into a dive attitude; said lauching part comprising an elongated flat metal or plastic part, pivotally mounted through a first hole near its front end, and containing two right-angle tabs, one at the top end and the other at the bottom end near the rear of the launching part, both tabs being bent in the same direction toward the back of the part such that the tabs straddle the fuselage when correctly mounted; said top tab containing a slot located near the rear end of said launching part; when correctly mounted, said slot surrounds said wire hook; said bottom tab being below said top tab and extending under said fuselage, said bottom tab operating to limit the upward motion of said launching part as it is bumped upward by said wing's motion; said launching part operating so that when at the upward limit of its motion, the slot in said top tab is completely above said wire hook and said launching part conceals said wire hook, thereby also providing safety from an accidental scratch of a person by said wire hook during the flyer's dive.

* * * * *